US006426669B1

(12) United States Patent
Friedman et al.

(10) Patent No.: US 6,426,669 B1
(45) Date of Patent: Jul. 30, 2002

(54) LOW VOLTAGE BANDGAP REFERENCE CIRCUIT

(75) Inventors: Jay Friedman, Felton; Ion E. Opris, Sunnyvale, both of CA (US)

(73) Assignee: National Semiconductor Corporation, Santa Clara, CA (US)

( * ) Notice: Subject to any disclaimer, the term of this patent is extended or adjusted under 35 U.S.C. 154(b) by 8 days.

(21) Appl. No.: 09/640,897

(22) Filed: Aug. 18, 2000

(Under 37 CFR 1.47)

(51) Int. Cl.[7] ..... G05F 1/100
(52) U.S. Cl. ..... 327/539; 327/540; 323/313
(58) Field of Search ..... 327/539, 540, 327/545; 323/313

(56) References Cited

U.S. PATENT DOCUMENTS 4,887,022 A * 12/1989 Gontowski ..... 323/284
5,068,606 A * 11/1991 Kawate et al. ..... 323/315
5,424,628 A * 6/1995 Nguyen ..... 323/314
5,488,289 A * 1/1996 Yeung ..... 323/312
5,715,532 A * 2/1998 Sagawa et al. ..... 455/317
5,926,062 A * 7/1999 Kuroda ..... 323/315
5,945,873 A * 8/1999 Antone et al. ..... 323/313
6,144,250 A * 11/2000 Owen et al. ..... 327/313
6,278,326 B1 * 8/2001 Murray et al. ..... 323/315

OTHER PUBLICATIONS

A Curvature–Corrected Low–Voltage Bandgap Reference, Gunawan, et al., 1993.

* cited by examiner

*Primary Examiner*—Terry D. Cunningham
(74) *Attorney, Agent, or Firm*—Stallman & Pollock LLP

(57) ABSTRACT

In a bandgap voltage reference circuit in accordance with the present invention, the different-sized emitters of the two bipolar devices of a $\Delta V_{BE}$ stage return to ground (or other bias voltage) through separate resistors. The $V_{BE}$ term of the reference device is supplied by a $V_{BE}$ current source through a third resistor. The proportional-to-absolute-temperature (PTAT) term of the reference occurs as the difference of base-emitter voltages $\Delta V_{BE}$ between the larger and smaller emitters. An output voltage $V_{out}$ multiplier resistor feeds to the larger emitter through an inverting amplifier. In one embodiment of the invention, the output voltage $V_{out}$ trim at one temperature is obtained by trimming the base-emitter resistor of the "small emitter" device to compensate for the $V_{BE}$ process variation.

6 Claims, 4 Drawing Sheets

LOW VOLTAGE BANDGAP REFERENCE CIRCUIT

BACKGROUND OF THE INVENTION

1. Field of the Invention

The present invention relates to semiconductor integrated circuits and, in particular, to a bandgap reference circuit that is capable of having output voltages below the nominal bandgap value and of being operated from very low supply voltages with a simple, one temperature trim procedure.

2. Discussion of the Related Art

In prior implementations of low voltage bandgap reference circuits, a proportional-to-absolute-temperature (PTAT) current is added to a current that is proportional to a base-emitter voltage $V_{BE}$ such that a constant current is applied to a resistor, thereby creating a constant voltage. Some designs of this type include a buffer amplifier.

The major disadvantages of this design approach lie in the Early voltage error in the current sources and in the difficulty of implementing a precision buffer amplifier for very low supply voltages. Another disadvantage of this prior art is the difficulty of trimming the ratio of the PTAT and $V_{BE}$ currents in an integrated circuit production environment. Two temperatures are usually required to obtain a low temperature coefficient.

SUMMARY OF THE INVENTION

The present invention provides a bandgap circuit capable of having an output voltage below a nominal bandgap value (1.206V) and of being operated from very low supply voltages.

In a bandgap voltage reference circuit in accordance with the present invention, the different-sized emitters of the two bipolar devices of a $\Delta V_{BE}$ stage return to ground (or other bias voltage) through separate resistors. The $V_{BE}$ term of the reference device is supplied by a $V_{BE}$ current source through a third resistor. The proportional-to-absolute-temperature (PTAT) term of the reference occurs as the difference of base-emitter voltages $\Delta V_{BE}$ between the larger and smaller emitters. An output voltage $V_{out}$ multiplier resistor feeds to the larger emitter through an inverting amplifier. In one embodiment of the invention, the output voltage $V_{out}$ trim at one temperature is obtained by trimming the base-emitter resistor of the "small emitter" device to compensate for the $V_{BE}$ process variation.

Further features and advantages of the present invention will become apparent from the following detailed description and accompanying drawings which set forth illustrative embodiments in which the principles of the invention are utilized.

DETAILED DESCRIPTION OF THE INVENTION

Figure 1:
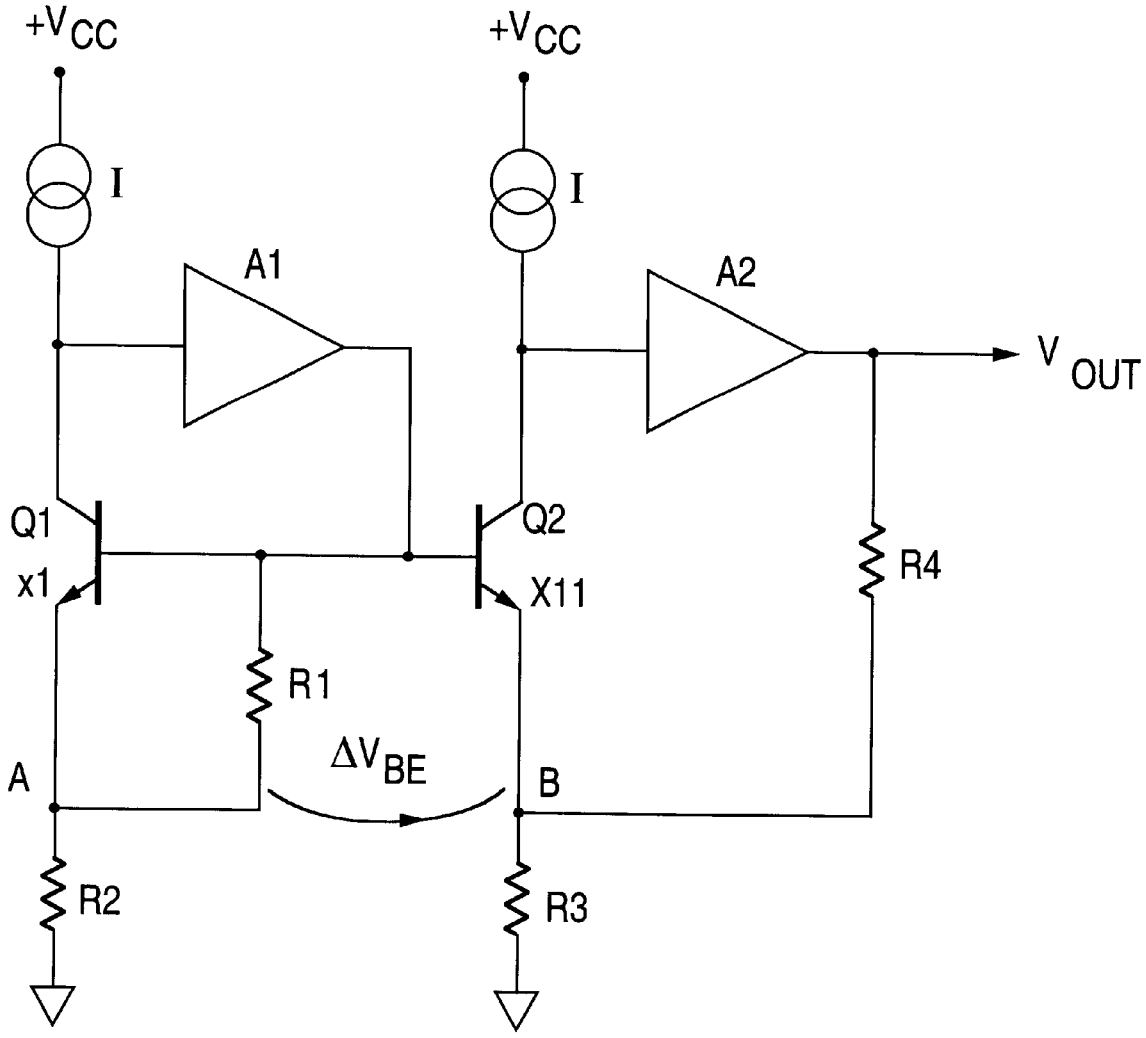
FIG. 1 is a schematic drawing illustrating the concepts of a low voltage bandgap reference circuit in accordance with the present invention.

A low voltage bandgap reference circuit in accordance with the present invention is shown in FIG. 1. The FIG. 1 circuit includes two bipolar NPN transistors $Q_1$ and $Q_2$ that have the same collector current I, but different emitter areas, shown in FIG. 1 as X1 and X4, respectively. Therefore, a proportional-to-absolute-temperature (PTAT) difference in the base-emitter voltage $\Delta V_{BE}$ develops between nodes A and B in accordance with the following equation:

$$\Delta V_{BE} = \frac{kT}{q} \cdot \ln(N) \tag{1}$$

An amplifier $A_1$ is used to set the collector current of transistor $Q_1$ equal to I. An inverting output amplifier $A_2$ maintains the equilibrium on the feedback loop with an output voltage $V_{out}$ such that equation (1) above is satisfied. The equilibrium condition can be written as $$I \cdot R_2 + V_{BE_1} \cdot \frac{R_2}{R_1} + \Delta V_{BE} = I \cdot \frac{R_3 \cdot R_4}{R_3 + R_4} + V_{out} \cdot \frac{R_3}{R_3 + R_4} \tag{2}$$

If the resistors $R_2$, $R_3$, and $R_4$ in the FIG. 1 circuit satisfy the following condition $$R_2 = \frac{R_3 \cdot R_4}{R_3 + R_4} \tag{3}$$

then the output voltage $$V_{out} = \frac{R_3 + R_4}{R_3} \cdot \left(\Delta V_{BE} + V_{BE_1} \cdot \frac{R_2}{R_1}\right) \tag{4}$$

is independent of the absolute value of the bias current I, except through the base emitter voltage $V_{BE1}$. This current can be generated with a conventional PTAT circuit, e.g., such as that found in National Semiconductor Corporation's LM334 product, and could also incorporate the bandgap curvature correction circuitry found in National Semiconductor Corporation's LM334 product.

Figure 2:
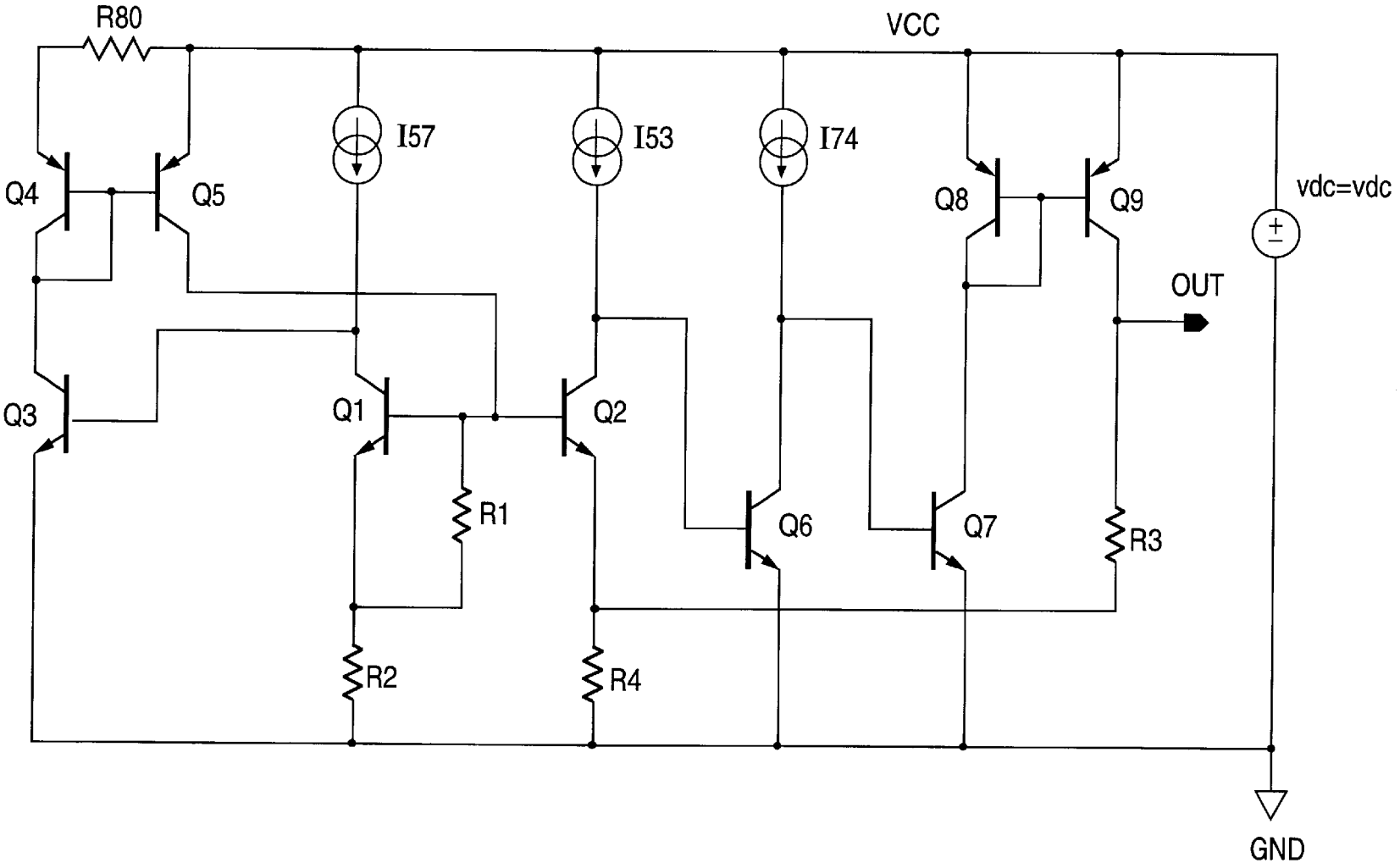
FIG. 2 is a schematic drawing illustrating a transistor-level implementation of a low voltage bandgap reference circuit in accordance with the present invention.

FIG. 2 shows a more detailed version of the FIG. 1 circuit. The amplifier $A_1$ of the FIG. 1 circuit is implemented utilizing transistors $Q_3$-$Q_5$, while the inverting output amplifier $A_2$ of the FIG. 1 circuit is implemented utilizing transistors $Q_6$–$Q_9$. In this configuration, transistors $Q_1$ and $Q_2$ have essentially identical base-collector voltage; therefore, errors due to the Early effect are minimized.

A major advantage of the FIG. 2 circuit is the possible trimming procedure. The output voltage $V_{out}$ given by equation (4) above is dependent only upon the $V_{out}$ ratio for other resistors. To obtain a null first order temperature coefficient, the ratio of the $V_{BE}$ and $\Delta V_{BE}$ contributions in the total output voltage $V_{out}$ has to be adjusted. This adjustment can be done by trimming resistor $R_1$. Equation (3) above is not affected by the trimming procedure. Conversely, since process variations e.g. ($I_{sat}$, emitter area) effect primarily the base-emitter voltage $V_{BE}$, this can be adjusted to the correct value by trimming the bias current I.

Figure 3:
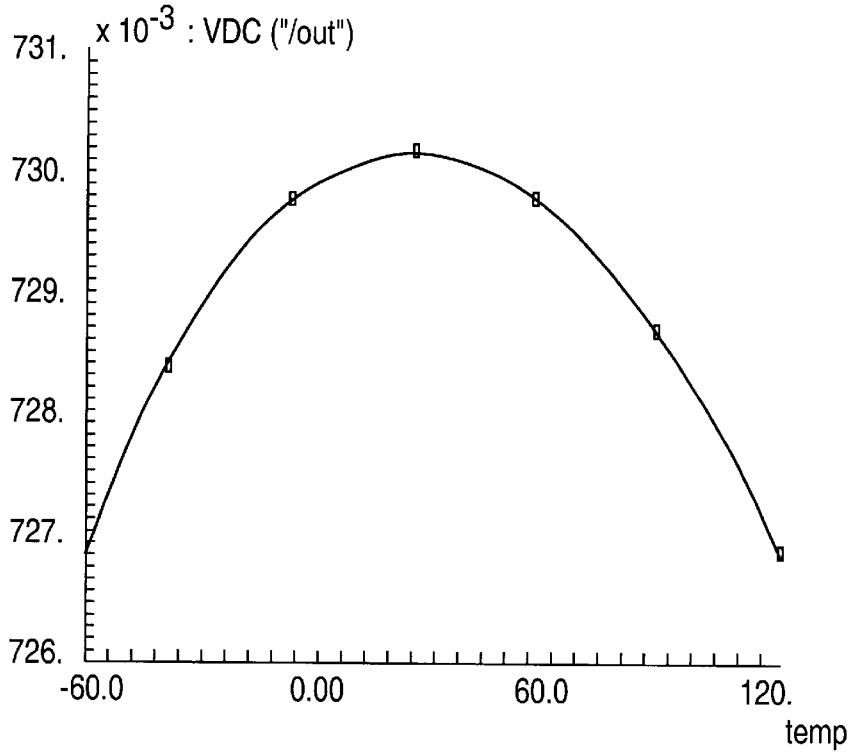
FIG. 3 is a graph illustrating bandgap curvature over a temperature range for a low voltage bandgap reference circuit in accordance with the present invention.

Ideal current sources have been used for the bias currents I. The total curvature over a large temperature range, shown in FIG. 3, is only about 3 mV, which, proportionally, corresponds to the normal bandgap curvature.

Figure 5:
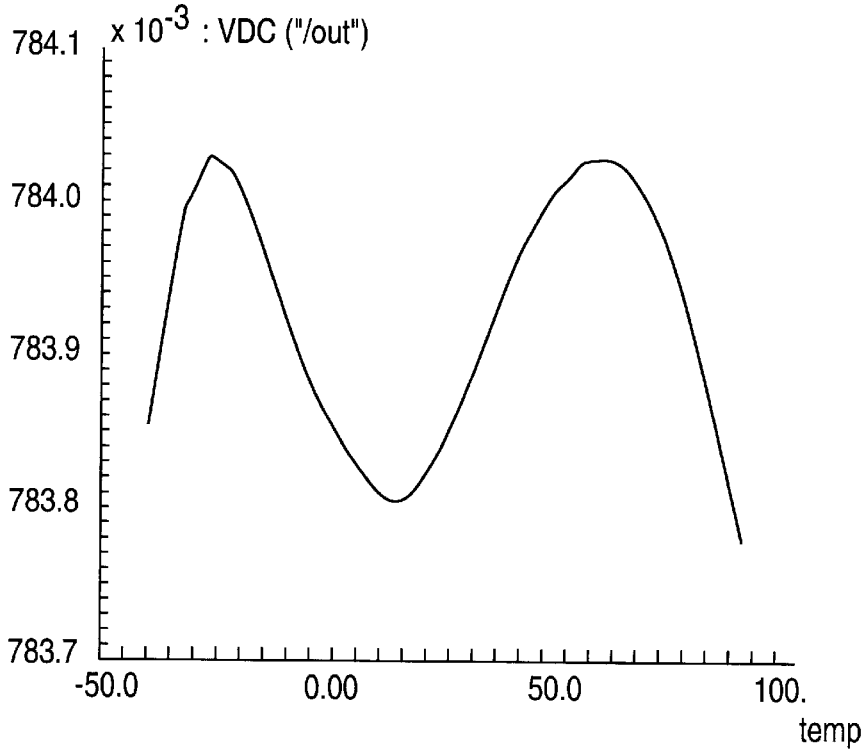
FIG. 5 is a graph illustrating output voltage variation over temperature for a low voltage bandgap reference circuit in accordance with the present invention.
Figure 4:
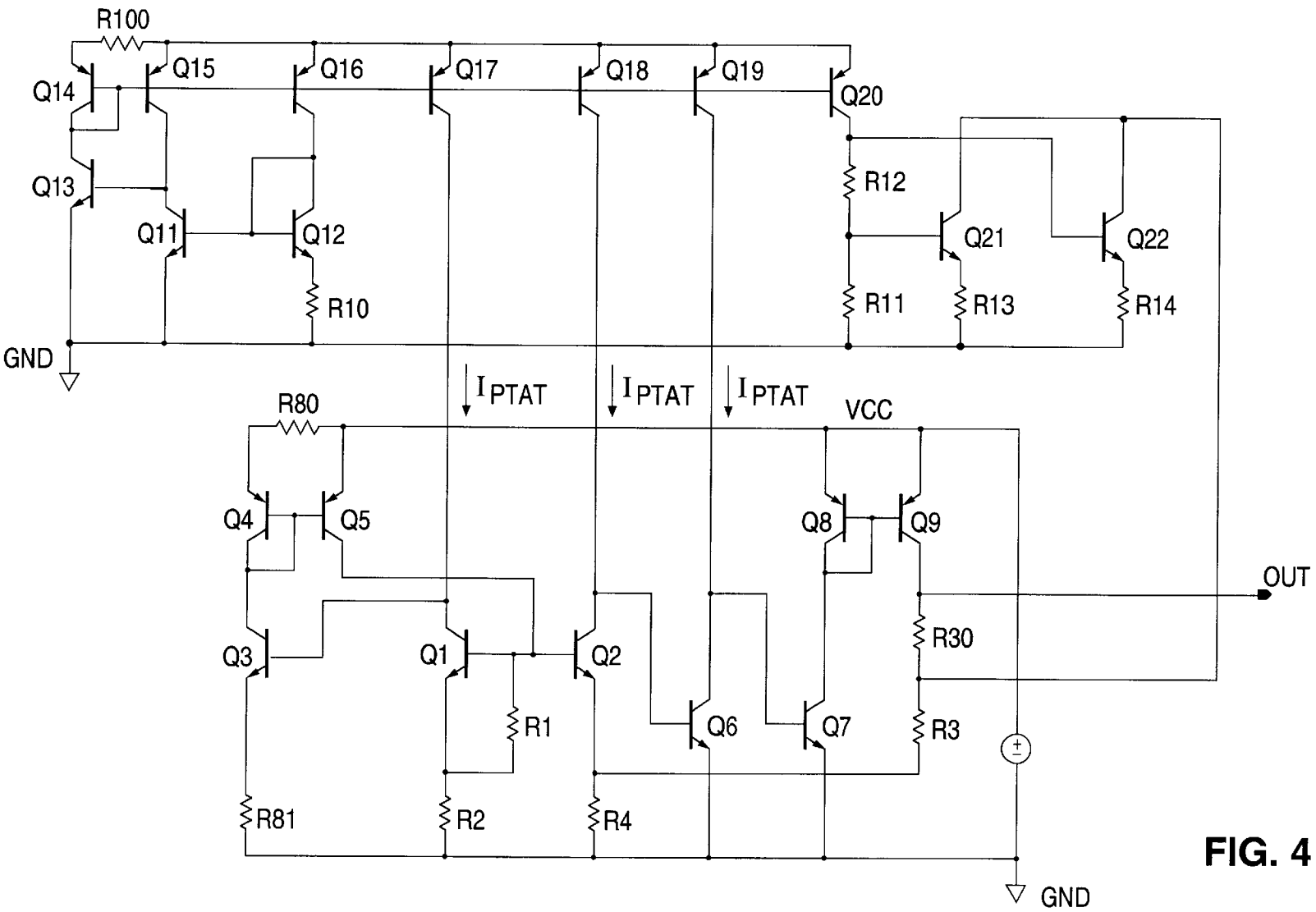
FIG. 4 is a schematic drawing illustrating an application of a low voltage bandgap reference circuit in accordance with the present invention.

A practical implementation of the FIG. 1 circuit is shown in FIG. 4. The PTAT difference in the base-emitter voltages of transistors $Q_{11}$ and $Q_{12}$ across the resistor $R_{10}$ determines a PTAT common bias current in the PNP transistors $Q_{15}$–$Q_{20}$. Supply rejection is good because all of the PNP current source transistors have essentially the same base-collector voltage. The NPN transistors $Q_{21}$–$Q_{22}$ are turned on only at high temperature, therefore providing a piecewise linear curvature correction. With this correction circuitry, the total output voltage variation in the −40 C. to +90 C. temperature range is less than 0.25 mV, as shown in FIG. 5, and remains less than 1 mV over an extended temperature range (−55 C. to +125 C.).

Referring back to FIG. 1, the core transistors $Q_1$ and $Q_2$ operate at the same collector voltages, which are determined by the input bias voltages of the amplifiers $A_1$ and $A_2$. This configuration eliminates the Early voltage error of the prior art.

Another advantage provided by the present invention is the very simple trimming procedure applied to resistor $R_1$ of FIG. 1. Assuming accurate $\Delta V_{BEs}$ and resistor ratios, the $Q_1$ base-emitter voltage $V_{BE}$ is the primary process variable and its contribution to the output voltage is trimmed by changing the value of $R_1$. The correct value of the $Q_1$ $V_{BE}$ voltage can also be adjusted by trimming the bias current I.

It should be understood that various alternatives to the embodiments of the invention described above may be employed in practicing the invention. It is intended that the following claims define the scope of the invention and that methods and structures within the scope of the claims and their equivalents be covered thereby.

What is claimed is:

1. A low voltage bandgap reference circuit comprising a first bipolar NPN transistor having a collector current I and having its emitter coupled to a bias voltage supply via a first resistor;

a second bipolar NPN transistor having the collector current I and having its emitter coupled to the bias voltage supply via a second resistor, the base of the first NPN transistor being connected to the base of the second transistor, the emitter of the second NPN transistor having an area that is greater than the area of the emitter of the first NPN transistor;

an inverting amplifier connected between the collector of the second NPN transistor and an output node $V_{out}$ of the bandgap reference circuit;

a third resistor connected between the base of the first NPN transistor and the emitter of the first NPN transistor;

a fourth resistor connected between the output node $V_{out}$ and the emitter of the second NPN transistor, wherein the second, third and fourth resistors satisfy the condition $$R_2 = \frac{R_3 \cdot R_4}{R_3 + R_4}; \text{ and}$$

an amplifier connected between the collector of the first NPN transistor and the commonly-connected bases of the first and second NPN transistors, whereby the amplifier sets the collector current of the first NPN transistor equal to I.

2. A low voltage bandgap reference circuit as in claim 1, and further comprising:

a trimming circuit connected to the third resistor to adjust the ration of the $V_{BE}$ and $\Delta V_{BE}$ contributions in the voltage at the output node $V_{out}$ such that a null first order temperature coefficient is obtained.

3. A low voltage bandgap reference circuit as in claim 1, and wherein the bias voltage supply is ground.

4. A low voltage bandgap reference circuit as in claim 1, and wherein the inverting amplifier comprises:

a third bipolar NPN transistor having its base connected to the collector of the second NPN transistor, its collector coupled to a positive voltage supply, and its emitter connected to the bias voltage supply;

a fourth bipolar NPN transistor having its base connected to the collector of the third NPN transistor and its emitter connected to the bias voltage supply;

a first bipolar PNP transistor having its emitter connected to the positive voltage supply, its collector connected to the collector of the fourth NPN transistor, and its base connected to its emitter; and a second bipolar PNP transistor having its emitter connected to the positive voltage supply, its collector connected to the output node $V_{out}$, and its base connected to the base of the first PNP transistor.

5. A low voltage bandgap reference circuit as in claim 1, and wherein the amplifier comprises:

a fifth bipolar NPN transistor having its emitter connected to the vias voltage supply and its base connected to the collector of the first NPP transistor;

a third bipolar PNP transistor having its emitter coupled to the positive voltage supply, its collector connected to the collector of the fifth NPN transistor, and its base connected to its collector; and a fourth bipolar PNP transistor having its emitter connected to the positive voltage supply, its collector connected to the commonly-connected bases of the first and second NPN transistors, and its base connected to the base of the third PNP transistor.

6. A low voltage bandgap reference circuit as in claim 5, and wherein the emitter of the third PNP transistor is coupled to the positive supply voltage via a fifth resistor ($R_8$).

* * * * *